US008277234B2

(12) United States Patent
Hopwood et al.

(10) Patent No.: US 8,277,234 B2
(45) **Date of Patent: *Oct. 2, 2012**

(54) INTERFACE BETWEEN CONNECTABLE ELECTRICAL DEVICES

(75) Inventors: Keith Hopwood, Fremont, CA (US); Chun Feng Chang, Taoyuan (TW)

(73) Assignee: Phihong USA Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/115,566

(22) Filed: May 25, 2011

(65) Prior Publication Data

US 2012/0015543 A1 Jan. 19, 2012

Related U.S. Application Data

(63) Continuation of application No. 12/468,008, filed on May 18, 2009, now Pat. No. 7,985,083.

(51) Int. Cl.
*H01R 13/44* (2006.01)

(52) U.S. Cl. ..... 439/131; 439/173; 320/114

(58) Field of Classification Search ..... 439/131, 439/173; 320/114

See application file for complete search history.

(56) References Cited

U.S. PATENT DOCUMENTS

| | | | | |
|---|---|---|---|---|
| 4,626,052 | A | 12/1986 | Rumble | |
| 4,973,827 | A * | 11/1990 | Nozaki | 219/521 |
| 5,613,863 | A * | 3/1997 | Klaus et al. | 439/131 |
| 6,443,753 | B1 | 9/2002 | Bludis et al. | |
| 6,773,277 | B2 | 8/2004 | Issa | |
| 7,008,246 | B2 * | 3/2006 | Zhuge | 439/173 |
| 7,118,399 | B1 | 10/2006 | Wen et al. | |
| 7,168,969 | B1 | 1/2007 | Wang | |
| 7,265,517 | B2 * | 9/2007 | Bumiller | 320/114 |
| 7,273,384 | B1 | 9/2007 | So | |
| 7,544,074 | B2 | 6/2009 | Buck et al. | |
| 7,547,219 | B2 * | 6/2009 | Zhuge | 439/173 |
| 7,597,570 | B2 | 10/2009 | So | |
| 2002/0081906 | A1 | 6/2002 | Kajiwara et al. | |
| 2002/0127918 | A1 | 9/2002 | Kajiwara | |

FOREIGN PATENT DOCUMENTS

JP 2002-141136 5/2002

OTHER PUBLICATIONS

International Search Report and Written Opinion dated Dec. 12, 2010, corresponding to Int'l. Appln. No. PCT/US2010/034981.

* cited by examiner

*Primary Examiner* — Truc Nguyen
(74) *Attorney, Agent, or Firm* — Fish & Richardson P.C.

(57) ABSTRACT

A system for engaging devices having connectable electrical connectors includes a first device and a second device. The first device has a first electrical connector exposed at a first surface that is contoured to define one or more recesses, each of which has a lip. The second device has a second electrical connector exposed at a second surface that is contoured to define one or more gripping elements, each of which fits into one of the recesses to grip one of the lips when the first and second electrical connectors are connected together. The first device also has a movable element that can be positioned such that when the one or more gripping elements are in the one or more recesses and gripping the one or more lips, the movable element blocks the gripping elements from being moved out of the recesses or away from the lips.

18 Claims, 9 Drawing Sheets

INTERFACE BETWEEN CONNECTABLE ELECTRICAL DEVICES

CROSS-REFERENCE TO RELATED APPLICATION

This application is a continuation of and claims the benefit of priority to U.S. patent application Ser. No. 12/468,008, filed on May 18, 2009, the disclosure of which is incorporated by reference herein in its entirety.

FIELD OF THE DISCLOSURE

This disclosure relates to an interface between connectable electrical devices, such as an electrical adapter and a charger that can be plugged into the electrical adapter.

BACKGROUND

A variety of electrical devices and components can be plugged into one another. One example is an electrical charger (e.g., for a mobile telephone or personal digital assistant) that can be plugged into an electrical adapter to enable the charger's plug, which has conductors configured in a manner suitable for use in a particular geographic region (e.g., the United States), to be plugged into an electrical socket configured according to standards of another region (e.g., Europe or Asia) by providing connections for the disparate contact arrangements.

SUMMARY OF THE DISCLOSURE

In one aspect, a system for engaging electrical devices having connectable electrical connectors includes a first device and a second device. The first device has a first electrical connector exposed at a first surface. The first surface is contoured to define one or more recesses, each of which has a lip. The second device has a second electrical connector exposed at a second surface. The second surface is contoured to define one or more gripping elements. Each gripping element fits into one of the recesses and grips a corresponding lip when the first and second electrical connectors are connected together. The first device also has a movable element that can be positioned in such a way that when the gripping elements are in the recesses and gripping the lips, the movable element physically obstructs the gripping elements from being moved out of the recesses or away from the lips.

In another aspect, a system includes a first device with a first electrical connector exposed at a first surface. The first surface of the first device is contoured to form one or more recesses, each of which has a lip. The system also includes a second device with a second electrical connector exposed at a second surface, wherein the second surface is contoured to define one or more gripping elements, each of which fits into one of the recesses to grip one of the lips when the first and second electrical connectors are connected together. The first device also has a movable element that can be positioned such that when the one or more gripping elements are in the one or more recesses and gripping the one or more lips, the movable element physically obstructs the gripping elements from being moved out of the recesses or away from the lips.

In some implementations, the first device is an electrical charger including a first set of electrically conductive prongs arranged according to a first configuration and the second device is an electrical adapter that has an electrical socket arranged to receive the first set of electrically conductive prongs and a second set of electrical prongs electrically coupled to the electrical socket and arranged according to a second configuration different from the first configuration.

According to certain embodiments, the first surface of the first device is contoured to form two recesses, and the second surface of the second device is contoured to define two gripping elements. In some implementations, each gripping element is substantially L-shaped and arranged to extend over an associated one of the lips.

Typically, the movable element is movable between the first position and a second position. Moreover, with the movable element in the second position, the one or more gripping elements are movable into the recesses to grip the lips or the one or more gripping elements are movable out of the recesses and away from the lips.

In some embodiments, the movable element has an actuating portion that is exposed at a surface of the first device other than the first surface and is operable to move the movable element between the first position and a second position. The recesses typically is at an edge of the first surface and spans between the first surface and a surface adjacent the first surface. Moreover, the actuating portion of the movable element typically is exposed for manipulation at the surface adjacent the first surface. Also, in some embodiments, the movable element has an elastic portion that flexes when the movable element is moved away from the first position to urge the movable element toward the first position. Alternatively, a separate spring may be provided to urge the movable element toward the first position.

According to some implementations, the first and second devices are electrically connectable to one another so that, when the first electrical connector is connected to the second electrical connector, the first surface of the first device contacts the second surface of the second device. Moreover, the second surface of the second device typically is further contoured to define one or more projections that physically obstruct a standard electrical plug from engaging the second electrical conductor a sufficient amount to establish electrical contact therewith. Additionally, in certain embodiments, the first surface of the first device is contoured to accommodate the one or more projections so that the one or more projections do not physically obstruct the first device from engaging the second electrical connector a sufficient amount to establish electrical contact therewith.

In some embodiments, the first electrical connector comprises electrically conductive prongs that are rotatably movable between an open position in which the electrically conductive prongs can engage an electrical socket of the second device and a closed position in which the electrically conductive prongs are folded into a trough in the first device. In those embodiments, the one or more of the projections of the second device fit into the trough of the first device when the electrically conductive prongs are connected to the electrical socket.

Another aspect includes a system that includes a first device with a first set of electrically conductive prongs arranged according to a first configuration and exposed at a first surface of the first device, and a second device with an electrical socket exposed at a second surface of the second device to receive the first set of electrically conductive prongs. The second surface is contoured to define one or more projections that physically obstruct a standard electrical plug from engaging the electrical socket a sufficient amount to establish electrical contact therewith. Moreover, the first surface of the first device is contoured to accommodate the one or more projections so that the one or more projections do not physically obstruct the first set of electrically conductive prongs from engaging the electrical socket a sufficient amount to establish electrical contact therewith.

In some implementations, the first device is an electrical charger. In some implementations, the second device is an electrical adapter and comprises a second set of electrically conductive prongs arranged according to a second configuration different from the first configuration.

In certain embodiments, the first and second devices are arranged such that, when the first set of electrically conductive prongs is connected to the electrical socket, the first surface of the first device contacts the second surface of the second device.

The first set of electrically conductive prongs can be rotatably movable between an open position in which the electrically conductive prongs can engage the electrical socket of the second device and a closed position in which the electrically conductive prongs are folded into a trough in the first device. Moreover, the one or more of the projections of the second device typically can fit into the trough of the first device when the first set of electrically conductive prongs is connected to the electrical socket.

According to some implementations, the first surface of the first device is contoured to form one or more recesses each of which has a lip and the second surface of the second device is contoured to define one or more gripping elements each of which fits into one of the recesses to grip one of the lips when the first and second electrical connectors are connected together. Moreover, the first device has an element movable to a first position such that when the one or more gripping elements are in the one or more recesses and gripping the one or more lips, the movable element blocks the gripping elements from being moved out of the recesses or away from the lips.

In yet another aspect, a system includes a first device with a first set of electrically conductive prongs arranged according to a first configuration and exposed at a first surface of the first device, wherein the first surface is contoured to form one or more recesses, one or more of which has a lip, and a second device comprising an electrical socket exposed at a second surface of the second device to receive the first set of electrically conductive prongs. The second surface is contoured to define one or more gripping elements, each of which fits into one of the recesses having lips to grip one of the lips when the electrically conductive prongs are connected to the electrical socket. The first device also has an element movable to a first position such that when the gripping elements are in the recesses and gripping the lips, the movable element physically obstructs the gripping elements from being moved out of the recesses or away from the lips. The second surface of the second device is contoured to define one or more projections that physically obstruct a standard electrical plug from engaging the electrical socket a sufficient amount to establish electrical contact therewith. Additionally, the first surface of the first device is contoured to accommodate the one or more projections in such a way that the one or more projections do not physically obstruct the first set of electrically conductive prongs from engaging the electrical socket a sufficient amount to establish electrical contact therewith.

In some embodiments, the first set of electrically conductive prongs is rotatably movable between an open position in which the electrically conductive prongs can engage an electrical socket of the second device and a closed position in which the electrically conductive prongs are folded into a trough in the first device. In such embodiments, the one or more of the projections of the second device fit into the trough of the first device when the first set of electrically conductive prongs is connected to the electrical socket.

In some implementations, one or more of the following advantages are present.

The inadvertent connecting of incompatible electrical devices (e.g., an electrical charger and an incompatible electrical adapter) can be avoided more easily.

Additionally, certain electrical devices, such as electrical adapters, may be subject to fewer safety tests to bring the devices to the marketplace, because those devices include features that help ensure the electrical devices are usable only with compatible electrical devices. For example, an electrical adapter may be subjected to fewer safety tests if it includes features that enable it to be connected to a charger specifically designed for use with the electrical adapter but prevent the electrical adapter, from being electrically connected to a standard U.S.-style two-pin plug. Accordingly, the cost of the electrical adapter can be reduced.

Additionally, some countries have regulations that tend to cause manufacturers permanently to attach an electrical adapter to a charger with which it is designed to work. In some implementations, the techniques described herein enable providing interchangeable electrical adapters for use with a single charger. Thus, in a single kit, for example, a charger may be sold along with interchangeable European, British and Australian adapters for the charger.

Other features and advantages will be apparent from the description and drawings, and from the claims.

A number of spatially relative terms, such as "front", "rear", "upper", "lower", "above", "beneath", "below", "lower", "horizontal", "vertical", and the like, are used herein to describe various relationships of elements relative to one another. These terms are used for convenience only and should not be construed in a manner that would limit the scope of what is otherwise described. For example, if a device is turned upside down, then the elements described as being "below" other elements would then be oriented "above" the other elements. Thus, in this example, the term "below" may mean above or below (or alongside) depending on the frame of reference.

DETAILED DESCRIPTION

Figure 1:
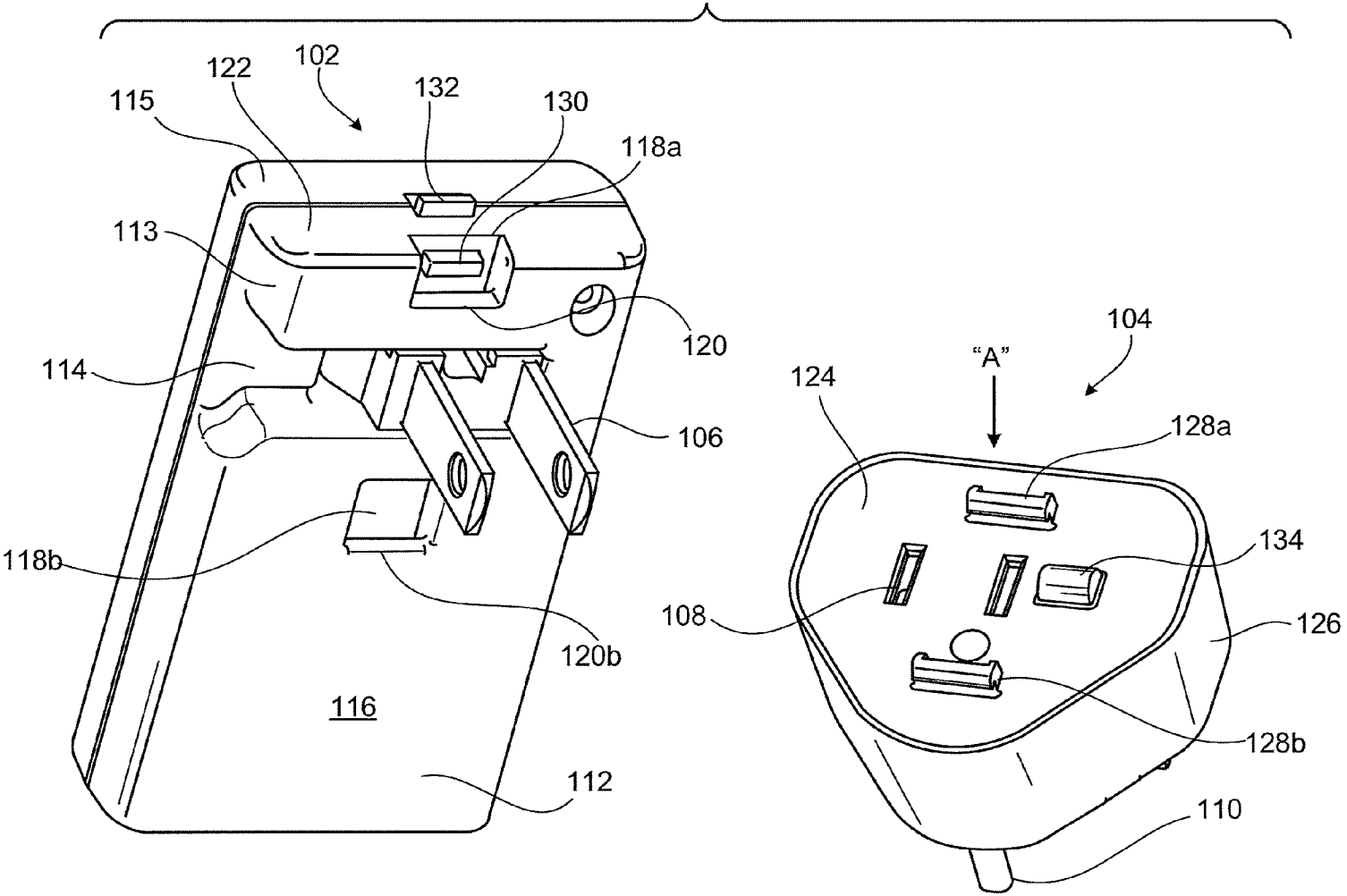
FIG. 1 is a perspective view of an electrical charger and an electrical adapter that have connectable electrical connectors.

FIG. 1 is a perspective view showing two electrical devices side-by-side with electrical connectors that are able to be connected to one another. In the illustrated implementation, the first electrical device is an electrical charger 102 (e.g., for a mobile telephone or personal digital assistant) that has foldable electrically conductive prongs 106 arranged according to a first configuration that enable the electrical charger 102 to be plugged directly into a standard electrical wall outlet as is commonly found, for example, throughout the United States.

In the illustrated implementation, the second electrical device is an electrical adapter 104 with a socket 108 that the charger's electrically conductive prongs 106 can be plugged into. The electrical adapter 104 has another set of electrically conductive prongs 110 that extends from its housing 126. This set of electrically conductive prongs 110 is electrically-coupled to the socket 108 and is arranged according to a second configuration that is different from the first configuration. In some implementations, this set of electrically conductive prongs 110 is arranged in such a manner that the adapter can be plugged directly into a style of electrical wall outlet found outside the Unites States (e.g., in Europe, Asia, Australia, etc.).

In use, the electrical charger 102 (which has U.S.-style prongs) can be plugged into the electrical adapter 104 (which has non-U.S.-style prongs), which, in turn, can be plugged into a non-U.S.-style wall outlet. In such an arrangement, the electrical adapter 104 enables the electrical charger 102 to receive electrical power from a wall outlet that the electrical charger 102 would not otherwise be able to be plugged into.

As discussed in further detail herein, the illustrated implementation includes features that make the charger 102 and adapter 104 difficult to separate once they are connected.

The illustrated charger 102 includes a substantially rectangular housing 112 having a front section 113 and a rear section 115 and six major surfaces. The foldable electrically conductive prongs 106 are able to swing between an open position (as shown in FIG. 1) in which the electrically conductive prongs 106 can engage the electrical socket 108 of the adapter 104 and a closed position (not shown in the figures) in which the electrically conductive prongs 106 are folded into a trough (or recess) 114 formed in the charger's housing 112. In the open position, the electrically conductive prongs 106 project outwardly from and substantially orthogonal to a first major surface 116 of the charger's housing 112.

In the illustrated implementation, the charger's housing 112 is contoured to form a pair of recesses 118*a*, 118*b* at least partially exposed at the first major surface 116. One recess 118*a* is above the electrically conductive prongs 106 and the other recess 118*b* is below the electrically conductive prongs 106. Recess 118*a* is at an upper edge of the first major surface 116 and spans from the first major surface 116 to an upper major surface 122 of the charger's housing 112 adjacent the first major surface 116. Each recess 118*a*, 118*b* has a lip 120*a*, 120*b* formed at a lower edge thereof. Thus, recess 118*a* has a lip 120*a* formed at the edge of the recess 118*a* closest to the electrically conductive prongs 106 and recess 118*b* has a lip 120*b* formed at an edge of the recess 118*b* at a far side of the recess 118*b* relative to the electrically conductive prongs 106.

The electrical socket 108, which is arranged to receive the charger's electrically conductive prongs 106, is exposed at a surface 124 of the adapter's housing 126 that is contoured to define two gripping elements 128*a*, 128*b*. Each gripping element 128*a*, 128*b* projects outwardly from a flat portion of the surface 124 and is sized, shaped and arranged so as to fit into a corresponding one of the recesses 118*a*, 118*b* in the charger's housing 112 when the electrically conductive prongs 106 are plugged into the socket 108. Moreover, each gripping element 128*a*, 128*b* has a far end that is bent downward so that it can fit behind and grip an associated one of the lips 120*a*, 120*b* when the charger's electrically conductive prongs 106 are plugged into the adapter's socket 108.

In some implementations, when the charger's electrically conductive prongs 106 are plugged into the adapter's socket 108, the gripping elements 128*a*, 128*b* fit into the recesses 118*a*, 118*b* substantially entirely. From that position, it may be necessary to apply a downward force to the adapter housing (as indicated by arrow "A" in FIG. 1) in order to move the bent far ends of the gripping elements 128*a*, 128*b* into position behind the lips 120*a*, 120*b*. In a typical implementation, therefore, the electrically conductive prongs 106 and the electrical socket 108 are arranged to accommodate a small amount of relative motion between the charger 102 and adapter 104 even when the prongs 106 are fully plugged into the socket 108. Once the bent far ends of the gripping elements 128*a*, 128*b* are in position behind the lips 120*a*, 120*b*, they substantially prevent the charger 102 from being pulled straight out of the adapter 104 unless an upward force (opposite arrow "A") also is applied to the adapter 104 relative to the charger 102 to disengage the gripping elements 128*a*, 128*b* from the lips 120*a*, 120*b*.

The illustrated charger 102 also has a movable element 130 that can be slid over the upper gripping element 128*a* when the upper gripping element 128*a* is in recess 118*a* so as to grip the upper lip 120*a*. In this position, the movable element 130 prevents the upper gripping element 128*a* from being removed from the upper lip 120*a* and the upper recess 118*a*. Moreover, since the upper gripping element 128*a* and the lower gripping element 128*b* are integrally formed as part of the adapter's housing 126, they move together. Therefore, when the movable element 130 is positioned to prevent the upper gripping element 128*a* from being removed from the upper recess 118*a* and upper lip 120*a*, the lower gripping element 128*b* also is prevented from being removed from the lower recess 118*b* and lower lip 120*b*.

Figure 2A:
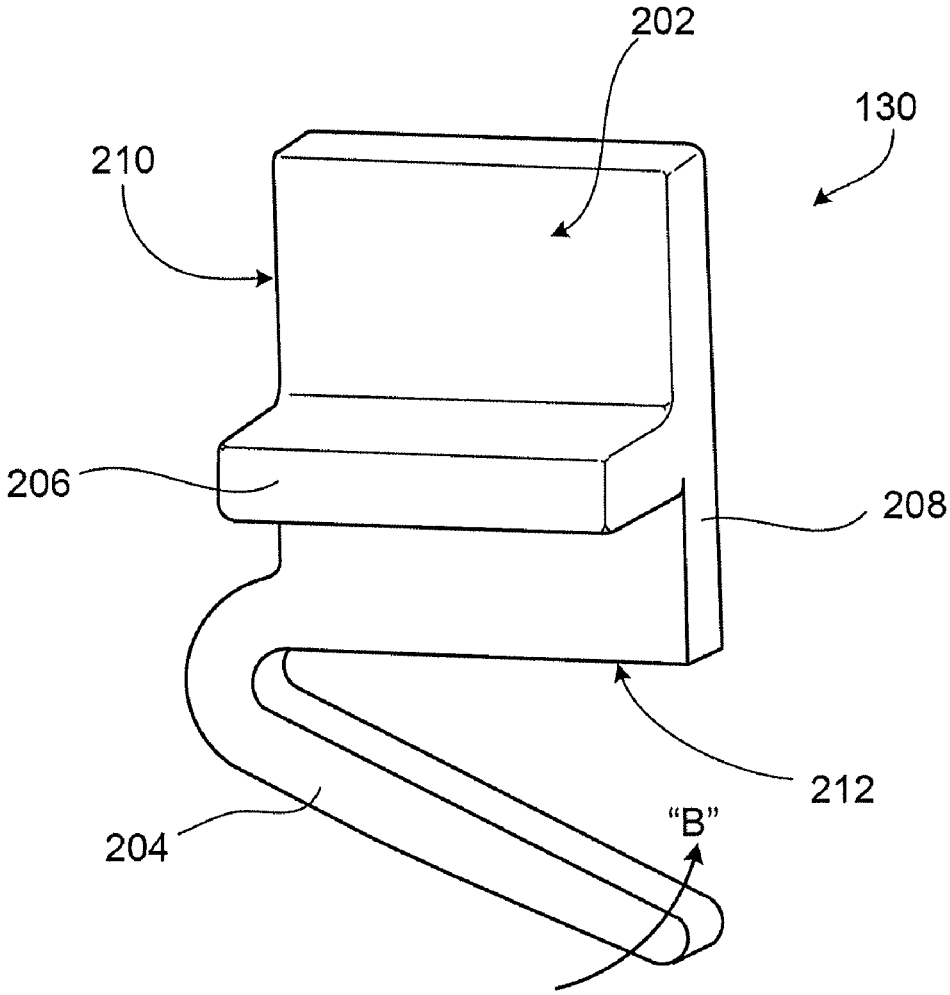
FIGS. 2A to 2C are perspective views showing details of a movable element and how it is coupled to the charger's housing.
Figure 2B:
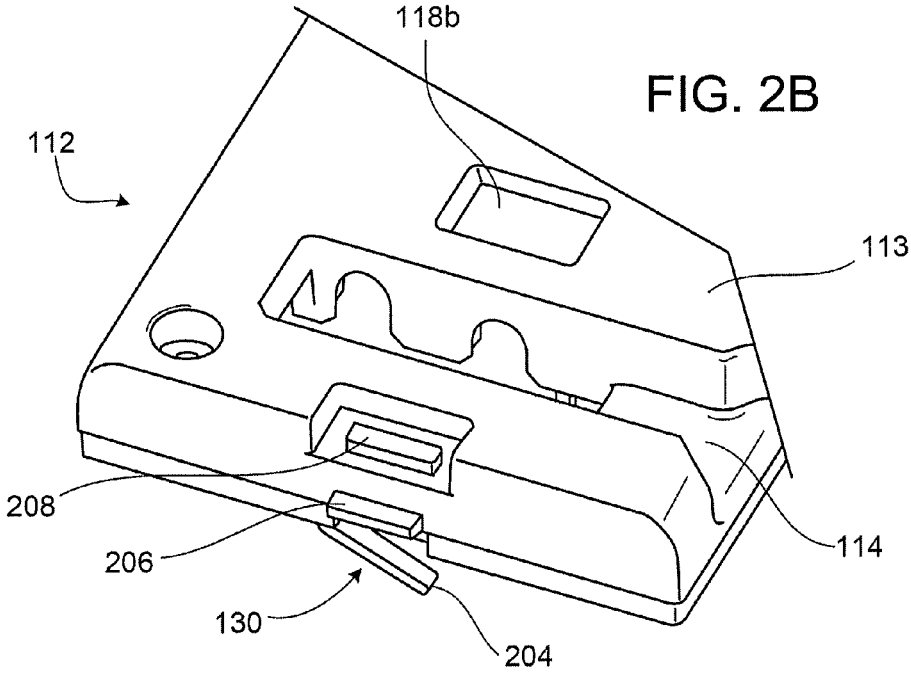
Figure 2C:
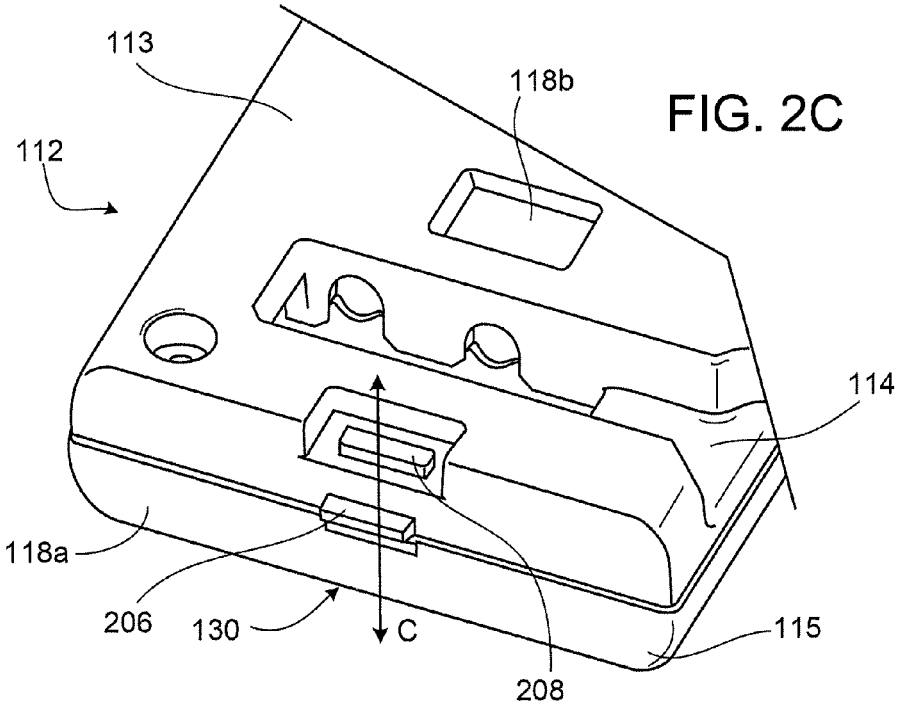

FIGS. 2A to 2C are perspective views showing details of the movable element 130 of FIG. 1 and how it is coupled to the charger's housing 112.

FIG. 2A shows the movable element 130, which includes a substantially T-shaped body 202 with a curved, elastic extension 204. As viewed in an upright manner, the substantially T-shaped body 202 has a horizontal section 208 and a vertical section 206 that extends perpendicularly from near the middle of the horizontal section 208. The curved elastic extension 204 extends from a first edge 210 of the horizontal section 208 at a corner of the horizontal portion 208. The elastic portion 204 lies in the same plane as the horizontal section 208 of the T-shape and is able to bend elastically toward a second edge 212 of the horizontal section 208 under the application of an appropriate force (indicated by arrow "B" in FIG. 2A). The second edge 212 is adjacent to the first edge 210.

FIG. 2B shows the movable element 130 positioned relative to the front section 113 of the charger's housing 112 as it would be in a full assembly.

The illustrated implementation shows that the movable element 130 is intended to be contained partially within the charger's housing 112. The horizontal section 208 of the T-shaped body 202 extends partially through an opening at a rear surface in recess 118*a*. This exposed portion of the horizontal section 208 can be slid over the adapter's gripping element 128*a* when the gripping element 128*a* is positioned in the recess 118*a*. The elastic portion 204 is shown extending in a direction substantially opposite the externally exposed portion of the T-shaped body's horizontal section 208.

FIG. 2C shows the movable element 130 assembled together with the front section 113 and rear section 115 of the charger's housing 112.

According to the illustrated implementation, part of the vertical section 206 of the T-shaped body 202 is exposed through an opening formed between the front 113 and rear 115 sections of the housing 112. This exposed part acts as an actuating portion for the movable element 130. The opening between the front 113 and rear 115 sections of the housing 112 that the actuating portion passes through is sized to allow the actuating portion to be moved in the direction indicated by the arrow labeled "C" a distance to enable the movable element 130 to slide a sufficient amount so that the exposed part of the horizontal section 208 of the T-shaped body 202 can capture and release a gripping element in the recess 118*a*.

In some implementations, the elastic section 204 is arranged to spring-load the movable element 130 to a position where it would physically obstruct a gripping element from being disengaged from the lip 120*a* and recess 118*a*.

Referring again to FIG. 1, the illustrated implementation includes features that enable the charger 102 to be plugged into the adapter 104, but that prevent other electrical devices (e.g., those that are not specifically designed for use with the adapter 104) from being plugged into the adapter 104.

In the illustrated implementation, the surface 124 of the electrical adapter 104 that has the electrical socket 108 is contoured to define a projection 134 sized, shaped and positioned so as to physically obstruct a standard electrical plug from engaging the electrical socket 108 a sufficient amount to establish electrical contact therewith. The projection 134, however, can fit into the charger's trough 114 when the prongs 106 are plugged into the socket 108.

As shown, the projection 134 is located close enough to the electrical socket 108 that the body of a standard electrical plug will be at least large enough to contact the projection 134 as the conductors of the standard electrical plug are being inserted into the electrical socket 108. This arrangement helps prevent electrical devices (with standard electrical plugs) that are not specifically designed to work with the electrical adapter 104 from being plugged into the electrical adapter 104.

In some implementations, one or more of the gripping elements 128*a*, 128*b* are positioned so as to physically obstruct a standard electrical plug from engaging the electrical socket 108 a sufficient amount to establish electrical contact therewith. In these implementations, the adapter 104 can include, for example, one or more gripping elements and one or more projections 134, or the adapter may include only one or more gripping elements to provide the physical obstruction.

As mentioned above, in the illustrated implementation, the first major surface 116 of the charger 102 is contoured to accommodate the projection 134 in such a way that the projection 134 does not physically obstruct the charger's 102 electrically conductive prongs 106 from fully engaging the electrical socket 108 to establish electrical contact therewith. In particular, in the illustrated implementation, the projection 134 is positioned so that when the electrically conductive prongs 106 are inserted into the electrical socket 108, the projection 134 fits into the trough 114 in the charger's housing 102. With the prongs 106 in an open (unfolded) configuration, the trough has a sufficient amount of space to accommodate the projection 134.

Figure 3A:
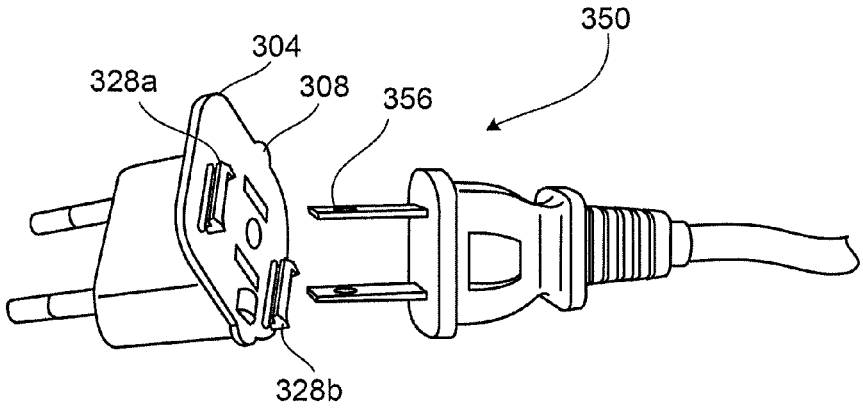
FIGS. 3A and 3B are perspective views of an electrical adapter and a standard U.S.-style plug.
Figure 3B:
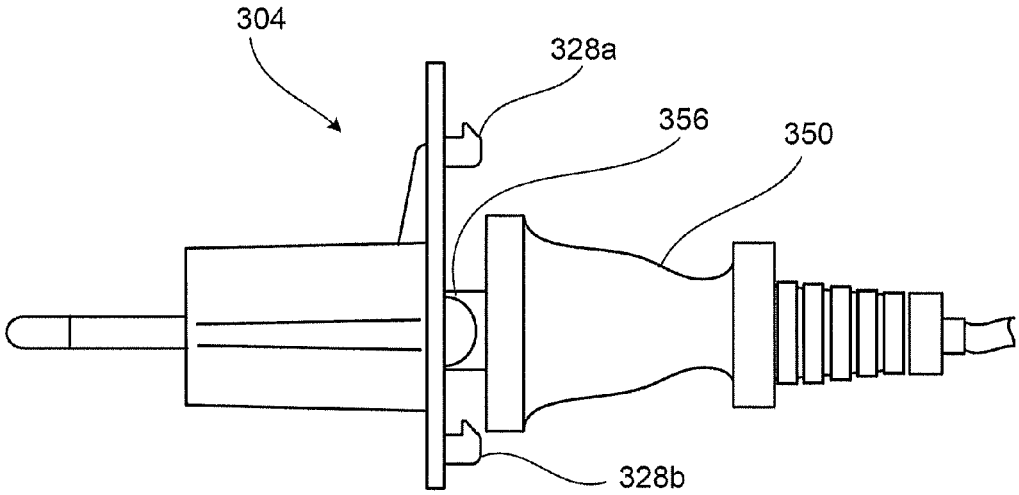

FIGS. 3A and 3B are perspective views of an electrical adapter 304 and a standard U.S.-style plug 350.

As illustrated, the plug 350 has electrically conductive prongs 356 that are arranged so that, absent physical obstructions, they can be coupled to the adapter's electrical socket 308. The illustrated adapter 304, however, has a pair of gripping elements 328*a*, 328*b* that are arranged to physically prevent the standard plug 350 from engaging the adapter 304 a sufficient amount to establish an electrical connection between the electrically conductive prongs 356 and the electrical socket 308. The electrically conductive prongs 356, therefore, are substantially prevented from entering the electrical socket 308 deeper than what is shown in FIG. 3B, because the contact face (i.e., the surface of plug, from which the electrically conductive prongs 356 extend) of the plug's dielectric housing contacts gripping element 328*b* as shown. This contact prevents the electrically conductive prongs 356*b* from entering the electrical socket 308 a sufficient amount to engage the electrical socket 308 electrically.

In some implementations, in order to provide physical obstruction of a standard-type plug, at least one of the gripping elements or a projection is positioned on the surface 124 of the adapter 104 so that it will physically contact the contact face of the standard-type plug's dielectric housing. A standard U.S. style electrical plug's contact face (for an electrical plug with two parallel electrically conductive prongs) typically has dimensions of approximately 1 inch wide by approximately ¾ inch high. Accordingly, in some implementations, at least one of the gripping elements or projections is positioned so as to physically obstruct a contact face having those dimensions. At the same time, all of the gripping elements and projections are positioned so that they do not obstruct full engagement of a charger (or other electrical device) that has corresponding recesses or contours to accommodate the gripping elements and projections.

Figure 4:
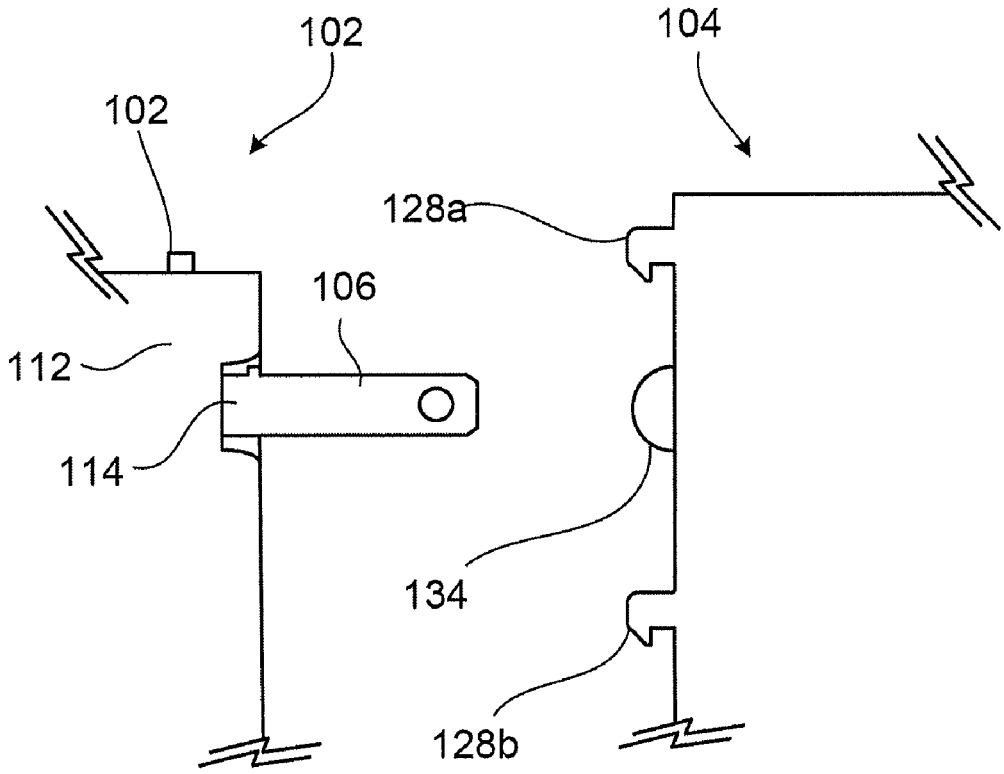
FIG. 4 is a partial side view of an electrical charger and an adapter

FIG. 4 is a partial side view of the electrical charger 102 and the adapter 104 of FIG. 1 facing each other so that the charger's electrically conductive prongs 106 extend toward the adapter's electrical socket (not visible in FIG. 4).

In the illustrated implementation, it can be seen that the gripping elements 128*a*, 128*b* have far ends that are bent in a downward direction. This shape enables the gripping elements to engage the lips (also not visible in FIG. 4) formed in the charger's housing. The projection 134 also is shown and can be seen to have a bump-shaped profile. The bump is sized so that it fits into the trough 114 in the charger's housing 112.

The actuating portion (i.e., the "vertical section 206") of the movable element 130 is exposed at an upper surface of the charger's housing 112. Notably, the actuating portion is exposed at a surface of the charger's housing that enables it to be accessed and manipulated by a user when the charger's prongs 106 are plugged into the adapter's electrical socket.

Figure 5A:
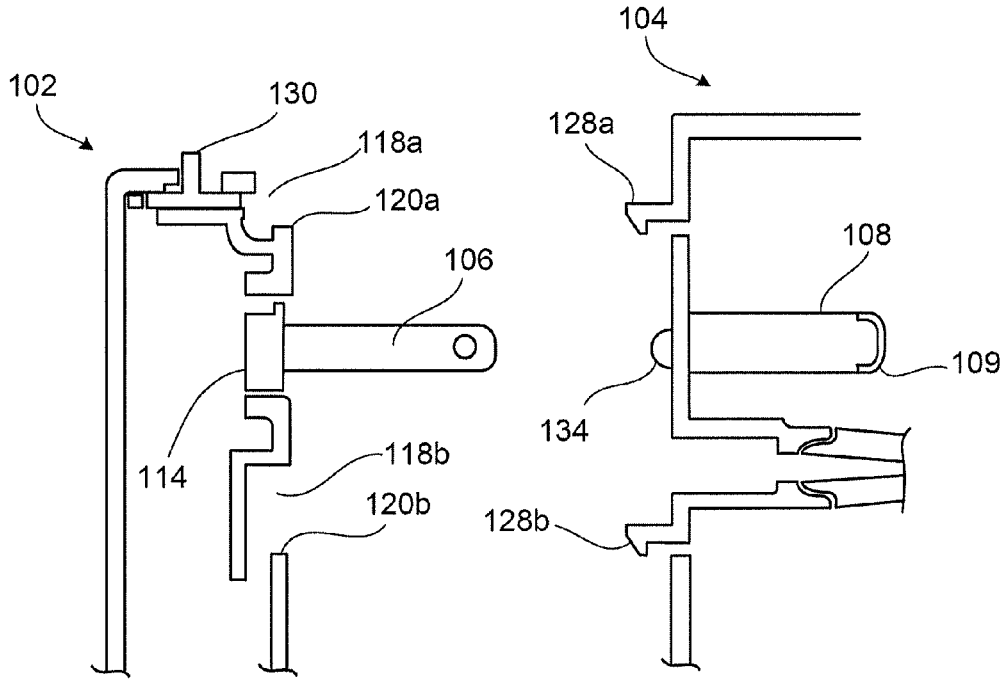
FIGS. 5A through 5C are partial cross-sectional side views of the charger and adapter of FIG. 4 at various stages of engagement.
Figure 5B:
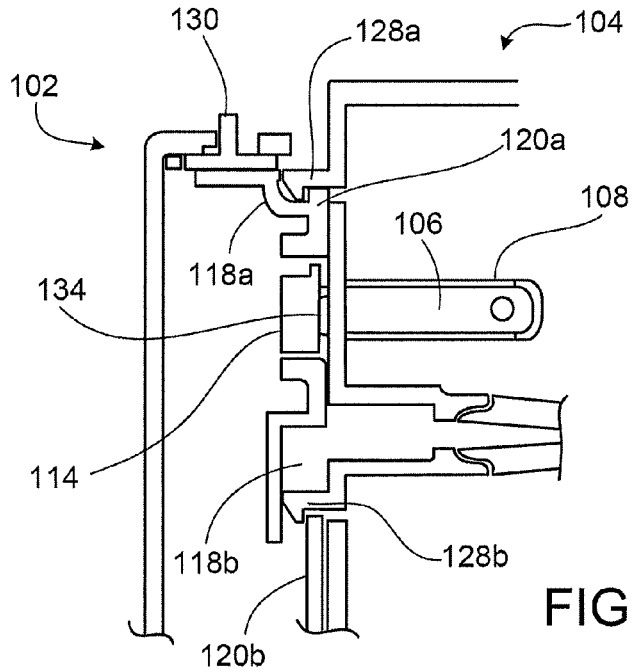
Figure 5C:
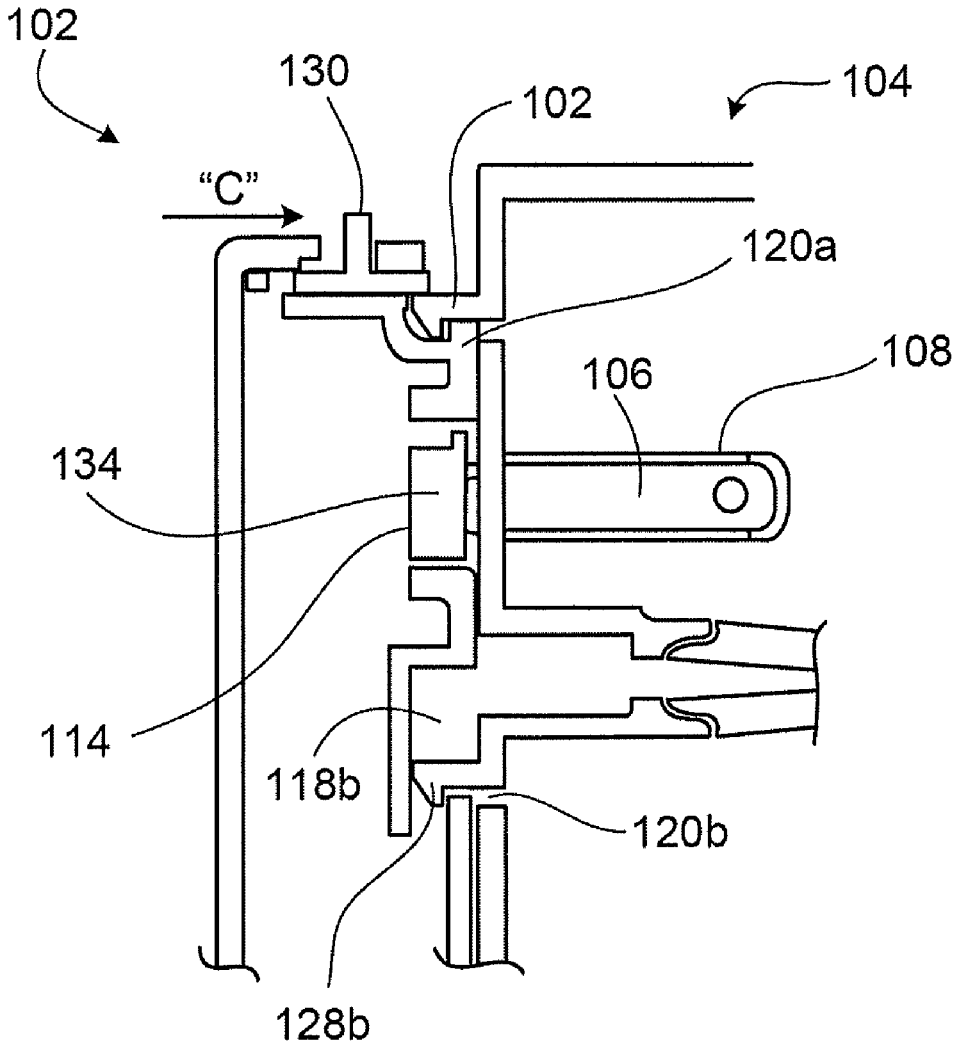

FIGS. 5A through 5C are partial cross-sectional views of the charger 102 and adapter 104 of FIG. 4 at various stages of engagement.

In FIG. 5A, the charger 102 and adapter 104 are shown facing one another, but are not plugged into one another.

As illustrated, the charger's housing is contoured to define a pair of recesses 118*a*, 118*b*, each of which has a lip 120*a*, 120*b* at a lower portion thereof. The electrical adapter's housing is contoured to define gripping elements 128*a*, 128*b* with far ends that are bent in a downward direction. The gripping elements 128*a*, 128*b* are sized, shaped and positioned to fit into the recesses 118*a*, 118*b* and to grip the lips 120*a*, 120*b* when the conductive prongs 106 are plugged into the electrical socket 108. Similarly, the projection 134 on the electrical adapter's housing is sized, shaped and positioned to fit into the trough 114 in the charger's housing when the conductive prongs 106 are plugged into the electrical socket 108.

In the illustrated implementation, electrically conductive material 109 is exposed at the bottom of the electrical socket 108. This electrically conductive material is electrically coupled to the adapter's internal circuitry and to the adapter's electrically conductive prongs (not shown in FIG. 5A, but see 110 in FIG. 1). The internal surfaces of the electrical socket 108 are otherwise not electrically coupled to the adapter's internal circuitry or electrically conductive prongs. In order to electrically engage the adapter, an electrically conductive prong (e.g., prong 106) must extend into the socket at least far enough to contact the exposed electrically conductive material 109.

In some implementations, the electrically conductive material 109 extends up from the bottom of the socket no more than the distance that the projection 134 extends out of the front surface of the adapter 104. This ensures that, unless a plug device, such as the charger 102 in FIG. 5A, is configured in such a way as to accommodate (or otherwise avoid) projection 134, the projection 134 will prevent the plug device from electrically engaging the adapter 104.

In FIG. 5B, the charger's electrical prongs 106 are fully plugged into the adapter's electrical socket 108. As such, gripping element 128*a* is positioned in recess 118*a* and is gripping lip 120*a*. In particular, the straight portion of the gripping element 128*a* extends over the lip 120*a* and the bent far end of the gripping element 128*a* extends downward behind the lip 120*a*. Similarly, gripping element 128*b* is positioned in recess 118*b* and is gripping lip 120*a*. In particular, the straight portion of the gripping element 128*b* extends over the lip 120*b* and the bent far end of the gripping element 128*b* extends downward behind the lip 120*b*. With the charger 102 and adapter 104 engaged as shown, the gripping elements 128*a*, 128*b* and lips 120*a*, 120*b* substantially prevents the charger 102 from being pulled apart without first lifting the gripping elements 128*a*, 128*b* out of engagement with the lips 120*a*, 120*b*.

In the illustrated implementation, the projection 134 is shown sitting within the trough 114 in the charger's housing.

In FIG. 5C, the charger's electrical prongs 106 are fully plugged into the adapter's electrical socket 108 and the movable element 130 has been slid (in a direction represented by arrow "C") over the upper gripping element 128*a*. This prevents the gripping elements 128*a*, 128*b* from being lifted out of engagement with the lips 120*a* and 120*b*. Accordingly, so long as a portion of the movable element 130 is in position to prevent disengagement, the charger 102 and the adapter 104 are essentially locked together by the interactions of the gripping elements 128*a*, 128*b*, the lips 120*a*, 120*b* and the movable element 130. Conveniently, however, the charger 102 and the adapter 104 can be disengaged from one another by simply sliding the movable element 130 in a direction opposite the direction of arrow "C" to the position shown in FIG. 5B, lifting the gripping elements 128*a*, 128*b* out of engagement with the lips 120*a*, 120*b* and pulling the charger 102 and adapter 104 apart.

Figure 6A:
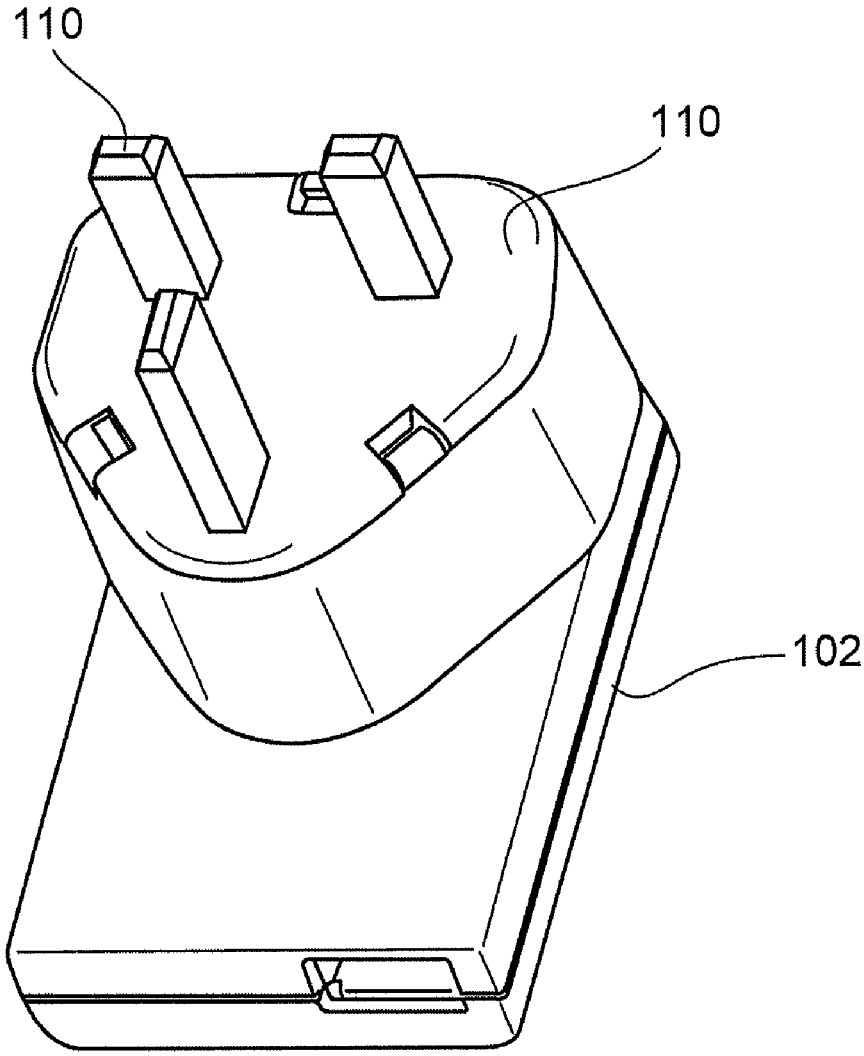
FIG. 6A is a perspective view showing the charger of FIG. 1 fully plugged into the adapter of FIG. 1.

FIG. 6A is a perspective view showing the charger 102 of FIG. 1 fully plugged into the adapter 104 of FIG. 1.

According to the illustrated implementation, the adapter's electrically conductive prongs 110 are arranged according to a configuration that enables them to be plugged into a standard wall outlet in Great Britain.

Figure 6B:
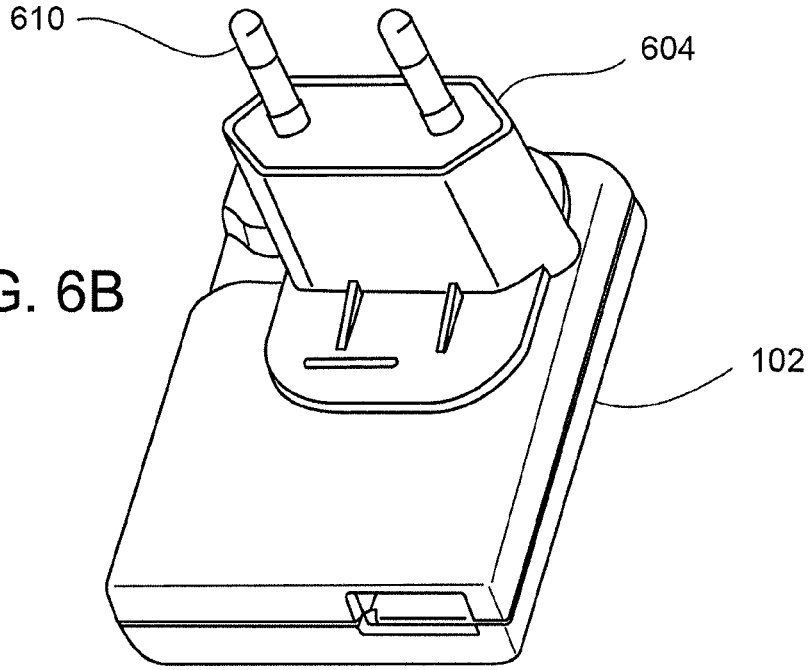
FIG. 6B is a perspective view showing the charger of FIG. 1 fully plugged into an adapter having a European-style electrically conductive prong configuration.

FIG. 6B is a perspective view showing the charger 102 of FIG. 1 fully plugged into an adapter 604 that has electrically conductive prongs 610 arranged according to a configuration that enables them to be plugged into a standard wall outlet in Europe.

Figure 6C:
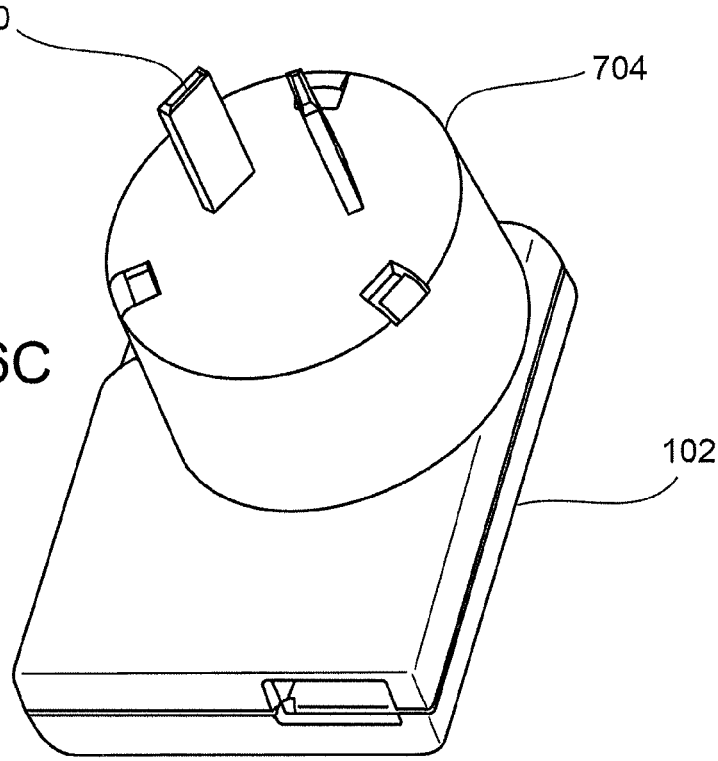
FIG. 6C is a perspective view showing the charger of FIG. 1 fully plugged into an adapter having an Australian-style electrically conductive prong configuration.

FIG. 6C is a perspective view showing the charger 102 of FIG. 1 fully plugged into an adapter 704 that has electrically conductive prongs 710 arranged according to a configuration that enables them to be plugged into a standard wall outlet in Australia.

In the implementations of FIGS. 6B and 6C, the adapters can include gripping elements and a projection similar to those shown on the adapter 104 of FIG. 1.

In some implementations, one charger may be used with a variety of different adapters, each having a different conductive prong configuration. In such an implementation, the variety of adapters gives a user the option of adapting the charger, which has a standard configuration to be connected to a variety of different electrical socket configurations (e.g., a European configuration, a Great Britain configuration, an Australian configuration, or any other configuration).

A number of embodiments of the invention have been described. Nevertheless, it will be understood that various modifications may be made without departing from the spirit and scope of the invention.

For example, the charger itself can have any configuration of electrically conductive prongs including, for example, a European configuration, a Great Britain configuration, an Australian configuration, or any other configuration that would render the charger directly connectable to an electrical socket in a particular geographic area anywhere in the world. Likewise, the electrically conductive prongs of the electrical adapter can have any configuration, including a United States-style configuration. The electrical socket of the electrical adapter can have any configuration as well.

The gripping elements and lips can be contoured in a variety of ways, but generally are designed so that they fit together in a way that will prevent the charger and adapter from being unplugged from one another. They also are configured so that a movable element can be positioned to block the gripping elements and lips from becoming disengaged. In some implementations, the gripping elements and the lips are fit tightly to one another and require the application of some force to engage them to one another.

The movable element 130 can have a variety of shapes and sizes. For example, in some implementations, the movable element does not include an elastic extension, as shown in FIG. 2A. In those implementations, other features can be provided to spring-load the movable element to a position where it can block the gripping element 128*a* from becoming disengaged from the recess 118*a* (i.e., a "blocking position"). For example, a separate spring can be provided next to the movable element and may be arranged so as to urge the movable element to the blocking position. Other spring-loading arrangements are possible as well.

In some implementations, the electrical adapter merely changes the configuration of electrically conductive prongs from one configuration to another configuration. In some implementations, the electrical adapter includes an internal transformer to step-up or step-down voltage. The electrical adapter can include other circuitry or features as well.

Certain embodiments include only one recess and only one gripping element. Other embodiments include more than two recesses and more than two gripping elements. Similarly, some embodiments include multiple projections to block engagement of standard plug to an adapter, but to allow the engagement of a specially designed charger. The projection (s) can be any shape and can be arranged in a variety of ways.

Some implementations do not include any projections, but include gripping elements, recesses with lips and movable elements. Some implementations do not include gripping elements, recesses with lips and movable elements, but do include projections.

Moreover, the techniques disclosed herein can be adapted to any electrical devices or components that may be plugged into one another.

Other implementations are within the scope of the claims.

What is claimed is:

1. A system comprising:

a first device comprising a first electrical connector exposed at a first surface, wherein the first surface is contoured to form one or more recesses, each of which has a lip; and a second device comprising a second electrical connector exposed at a second surface, wherein the second surface is contoured to define one or more gripping elements, each of which fits into one of the recesses to grip one of the lips when the first and second electrical connectors are connected together;

wherein the first device further comprises a movable element that can be positioned such that when the one or more gripping elements are in the one or more recesses and gripping the one or more lips, the movable element physically obstructs the gripping elements from being moved out of the recesses or away from the lips, wherein the first electrical connector comprises a first set of electrically conductive prongs configured so that the electrically conductive prongs can be plugged directly into a standard electrical wall outlet, and wherein each gripping element is substantially L-shaped and arranged to extend over an associated one of the lips.

2. The system of claim 1 wherein the second device further comprises:

an electrical socket to receive the set of electrically conductive prongs, and a second set of electrically conductive prongs electrically coupled to the electrical socket and arranged according to a second configuration different from the configuration of the first set of electrically conductive prongs.

3. The system of claim 1 wherein the first surface of the first device is contoured to form two recesses, and the second surface of the second device is contoured to define two gripping elements.

4. The system of claim 1 wherein the movable element is movable between the first position and a second position, wherein, with the movable element in the second position, the one or more gripping elements are movable into the recesses to grip the lips; or the one or more gripping elements are movable out of the recesses and away from the lips.

5. The system of claim 1 wherein the first and second devices are electrically connectable to one another so that, when the first electrical connector is electrically connected to and fully engaged with the second electrical connector, the first surface of the first device contacts the second surface of the second device.

6. The system of claim 1 wherein the first set of electrically conductive prongs is arranged so that the electrically conductive prongs of the first set can be plugged directly into a standard United States style electrical wall outlet, and wherein the second electrical connector comprises an electrical socket to receive the electrically conductive prongs.

7. The system of claim 1 wherein the first device is an electrical charger and the second device is an electrical adapter.

8. The system of claim 4 wherein the movable element comprises an actuating portion that is exposed at a surface of the first device other than the first surface and is operable to move the movable element between the first position and the second position.

9. The system of claim 8 wherein at least one of the recesses is at an edge of the first surface and spans between the first surface and the surface of the first device here the actuating portion is exposed.

10. The system of claim 8 wherein the movable element comprises an elastic portion that flexes when the movable element is moved away from the first position to urge the movable element toward the first position.

11. A system comprising:

a first device comprising a first electrical connector exposed at a first surface, wherein the first surface is contoured to form one or more recesses, each of which has a lip; and a second device comprising a second electrical connector exposed at a second surface, wherein the second surface is contoured to define one or more gripping elements, each of which fits into one of the recesses to grip one of the lips when the first and second electrical connectors are connected together;

wherein the first device further comprises a movable element that can be positioned such that when the one or more gripping elements are in the one or more recesses and gripping the one or more lips, the movable element physically obstructs the gripping elements from being moved out of the recesses or away from the lips, wherein the first electrical connector comprises a first set of electrically conductive prongs configured so that the electrically conductive prongs can be plugged directly into a standard electrical wall outlet, wherein the first and second devices are electrically connectable to one another so that, when the first electrical connector is electrically connected to and fully engaged with the second electrical connector, the first surface of the first device contacts the second surface of the second device, and wherein the second surface of the second device is further contoured to define one or more projections that physically obstruct a standard electrical plug from engaging the second electrical conductor a sufficient amount to establish electrical contact therewith.

12. The system of claim 11 wherein the first surface of the first device is contoured to accommodate the one or more projections so that the one or more projections do not physically obstruct the first electrical connector of the first device from engaging the second electrical connector a sufficient amount to establish electrical contact therewith.

13. The system of claim 12 wherein the first set of electrically conductive prongs are rotatably movable between an open position in which the electrically conductive prongs of the first set can engage an electrical socket of the second device and a closed position in which the electrically conductive prongs of the first set are folded into a trough in the first device, and wherein the one or more of the projections of the second device fit into the trough of the first device when the electrically conductive prongs of the first set are connected to the second electrical connector.

14. A system comprising:

a first device comprising a first electrical connector exposed at a first surface, wherein the first surface is contoured to form one or more recesses, each of which has a lip; and a second device comprising a second electrical connector exposed at a second surface, wherein the second surface is contoured to define one or more gripping elements, each of which fits into one of the recesses to grip one of the lips when the first and second electrical connectors are connected together;

wherein the first device further comprises a movable element that can be positioned such that when the one or more gripping elements are in the one or more recesses and gripping the one or more lips, the movable element can be positioned to physically obstruct the gripping elements from being moved out of the recesses or away from the lips, wherein a first one of the first or second electrical connectors comprises a pair of straight, substantially parallel, electrically conductive prongs, wherein a second one of the first or second electrical connectors comprises an electrical socket with a pair of openings adapted to receive and electrically engage the pair of straight, substantially parallel, electrically conductive prongs, and wherein each gripping element is substantially L-shaped and arranged to extend over an associated one of the lips.

15. The system of claim 14 wherein the pair of straight, substantially parallel, electrically conductive prongs are arranged so as to be plugged directly into a standard electrical wall outlet.

16. The system of claim 14 wherein the first or second device that has the electrical socket with the pair of openings further comprises:

a set of electrically conductive prongs that are electrically coupled to the electrical socket and arranged according to a configuration that is different than the configuration of the pair of straight, substantially parallel, electrically conductive prongs.

17. The system of claim 14 wherein the first and second devices are electrically connectable to one another so that, when the first electrical connector is electrically connected to and fully engaged with the second electrical connector, the first surface of the first device physically contacts the second surface of the second device.

18. The system of claim 14 wherein the first surface of the first device or the second surface of the second device is further contoured to define one or more projections that physically obstruct a standard electrical plug from engaging the first electrical connector or the second electrical connector a sufficient amount to establish electrical contact therewith, and wherein the first surface of the first device or the second surface of the second device is contoured to accommodate the one or more projections so that the one or more projections do not physically obstruct the first device from engaging the second electrical connector a sufficient amount to establish electrical contact therebetween.

* * * * *

UNITED STATES PATENT AND TRADEMARK OFFICE

CERTIFICATE OF CORRECTION

PATENT NO. : 8,277,234 B2
APPLICATION NO. : 13/115566
DATED : October 2, 2012
INVENTOR(S) : Keith Hopwood and Chun Feng Chang It is certified that error appears in the above-identified patent and that said Letters Patent is hereby corrected as shown below:

Column 12, Line 6, Claim 9, delete "here" and insert -- where --;

Column 12, Line 42, Claim 11, delete "conductor" and insert -- connector --.

Signed and Sealed this
Fifteenth Day of January, 2013

David J. Kappos

David J. Kappos
*Director of the United States Patent and Trademark Office*